US006221209B1

(12) United States Patent
Desprez et al.

(10) Patent No.: US 6,221,209 B1
(45) Date of Patent: Apr. 24, 2001

(54) MULTI-STAGE BLEACHING PROCESS HAVING A FINAL STABILIZED PEROXIDE STAGE

(75) Inventors: François Desprez; Johan Devenyns; Nicholas Troughton; Paul Essemaeker, all of Brussels (BE)

(73) Assignee: Solvay Interox (Société Anonyme), Brussels (BE)

( * ) Notice: Subject to any disclaimer, the term of this patent is extended or adjusted under 35 U.S.C. 154(b) by 0 days.

(21) Appl. No.: 08/083,183

(22) Filed: Jun. 29, 1993

(30) Foreign Application Priority Data

Jul. 6, 1992 (BE) ..... 09200626

(51) Int. Cl.[7] ..... D21C 9/14; D21C 9/147; D21C 9/153; D21C 9/16

(52) U.S. Cl. ..... 162/65; 162/76; 162/78; 162/88

(58) Field of Search ..... 162/60, 78, 76, 162/88, 89, 65

(56) References Cited

U.S. PATENT DOCUMENTS 4,450,044 * 5/1984 Fritzvold et al. ..... 162/78
4,938,842 7/1990 Whiting et al. .
4,946,556 * 8/1990 Prough ..... 162/60
5,145,557 * 9/1992 Peter et al. ..... 162/78

FOREIGN PATENT DOCUMENTS 402 335 * 12/1990 (EP) .
0415149A2 3/1991 (EP) .

OTHER PUBLICATIONS

Kirk–Othmer, "Encyclopedia of Chemical Technology", *A Wiley–Interscience Publication*, 1982, 3rd Edition, vol. 19, pp. 415 and 416.
J. Kappel, "HC–Peroxidbleiche für Zellstoff", *Wochenblatt Für Papierfabrikation*, 1992, No. 9, pp. 328, 330–334.
Ullman's, "Encyclopedia of Industrial Chemistry", *VCH Verlagsgesellschaft mbH*, 1991, 5th Edition, vol. A 18, pp. 568–569.

* cited by examiner

*Primary Examiner*—Steve Alvo
(74) *Attorney, Agent, or Firm*—Venable; George H. Spencer; Ashley J. Wells

(57) ABSTRACT

Process for bleaching a chemical paper pulp to a brightness of at least 89° ISO, consisting in subjecting the pulp to a treatment sequence of several stages including a final bleaching stage with hydrogen peroxide in alkaline medium carried out in the presence of at least one stabilising agent and at a consistency of at least 25% by weight of solids, the stages preceding this final stage having purified the pulp so that its manganese content does not exceed 3 ppm by weight with respect to the solids and that the pulp has been delignified beforehand to a kappa number not exceeding 5.

13 Claims, No Drawings

MULTI-STAGE BLEACHING PROCESS HAVING A FINAL STABILIZED PEROXIDE STAGE

FIELD OF THE INVENTION

The invention relates to a process for bleaching cellulose paper pulps belonging to the chemical pulps class.

TECHNOLOGY REVIEW

It is known to treat unbleached chemical paper pulps obtained by cooking lignocellulose materials by means of a sequence of delignifying and/or bleaching treatment stages involving the use of oxidising chemical products. The first stage of a conventional sequence of chemical pulp bleaching has the object of perfecting the delignification of the unbleached pulp as it exists after the cooking operation. This first delignifying stage is traditionally carried out by treating the unbleached pulp with chlorine in acidic medium or with a chlorine/chlorine dioxide combination, as a mixture or in sequence, so as to react with the residual lignin of the pulp and to give rise to chlorolignins which could be extracted from the pulp by solubilisation of these chlorolignins in alkaline medium in a subsequent treatment stage.

For various reasons, it proves useful, in certain situations, to be able to replace this first delignifying stage by a treatment which no longer requires a chlorinated reactant or which uses a decreased amount of chlorinated reactants.

For about ten years, it has been proposed to replace the first treatment stage by means of chlorine or the chlorine/chlorine dioxide combination, at least partially, by a stage with gaseous oxygen in alkaline medium (Kirk-Othmer, Encyclopedia of Chemical Technology, Third Edition, Vol. 19, New York 1982, page 415, 3rd paragraph and page 416, 1st and 2nd paragraphs). The degree of delignification which is obtained by this treatment with oxygen is not, however, sufficient if the aim is to produce chemical pulps of high brightness.

It has been proposed to bleach sulphite or sulphate pulps by means of high-strength hydrogen peroxide in the presence of sodium silicate (J. Kappel, HC-Peroxidbleiche für Zellstoff, Wochenblatt für Papier-fabrikation, 120, May 1992, No. 9, pages 328–334). It is, however, difficult with this process to produce a final brightness greater than 85° ISO, even at the price of significant amounts of hydrogen peroxide greater than 3 g/100 g of dry pulp.

The invention overcomes these disadvantages of the known processes, by providing a new delignification and/or bleaching process for chemical paper pulps which makes it possible to achieve high levels of brightness without excessive damage to the cellulose.

SUMMARY OF THE INVENTION

To this end, the invention relates to a process for bleaching a chemical paper pulp which makes it possible to obtain high levels of brightness, of at least 89° ISO, according to which the pulp is subjected to a sequence of treatment stages including a final stage with hydrogen peroxide in alkaline medium, the final stage with hydrogen peroxide being carried out in the presence of at least one stabilising agent and at a consistency of at least 25%, the pulp which is subjected to the final stage with hydrogen peroxide having been purified in the preceding stages so that its manganese content does not exceed 3 ppm by weight with respect to the solids and having been delignified to a kappa number (measured according to the SCAN standard C1-59) not exceeding 5.

DETAILED DESCRIPTION OF THE INVENTION

According to the invention, chemical paper pulp is understood to denote the pulps which have already been subjected to a delignifying treatment in the presence of chemical reactants such as sodium sulphide in alkaline medium (kraft cooking or sulphate cooking), sulphur dioxide or a metal salt of sulphurous acid in acidic medium (sulphite cooking or bisulphite cooking). According to the invention, chemical paper pulp is also understood to denote the pulps called in the literature "semi-chemical pulps", such as those where the cooking was carried out using a salt of sulphurous acid in neutral medium (neutral sulphite cooking, also called NSSC cooking), as well as the pulps obtained by processes using solvents, such as the Organosolv, Alcell®, Organocell® and Asam pulps described in Ullmann's Encyclopedia of Industrial Chemistry, 5th Edition, Vol. A18, 1991, pages 568 and 569.

This is particularly aimed at the pulps which have been subjected to a kraft cooking. All the types of wood used for the production of chemical pulps are suitable for the use of the process of the invention, and in particular those used for kraft pulps, namely soft-woods such as, for example, the various species of pine and fir, and the hardwoods such as, for example, beech, oak, eucalyptus and hornbeam.

According to the invention, the bleaching process includes a final bleaching stage with hydrogen peroxide in alkaline medium which is carried out at the end of the bleaching sequence. Preferably, the final bleaching stage with hydrogen peroxide ends this sequence.

This final stage with hydrogen peroxide is carried out, in accordance with the invention, in the presence of at least one stabilising agent. The known stabilising agents of peroxygenated products are well suited. Examples of such stabilising agents are alkaline-earth metal salts, in particular soluble magnesium salts, inorganic silicates, phosphates and polyphosphates such as the silicates, pyrophosphates and metaphosphates of alkali metals, organic polycarboxylates and aminopoly-carboxylates such as tartaric, citric, gluconic, ethylenediaminetetraacetic, diethylenetriaminepentaacetic or cyclohexanediaminetetraacetic acid and their salts, poly-α-hydroxyacrylic acids and their salts and the phosphonic acids such as ethylenediaminetetra (methylenephosphonic), diethylenetriaminepenta (methylenephosphonic) or cyclohexanediaminetetra (methylenephosphonic) acid and their salts. It is also possible to combine a number of these stabilising agents as a mixture. As a general rule, the silicates, polycarboxylates or phosphonic acids are well suited, in particular when they are combined with at least one magnesium salt. Sodium silicate has given good results.

The amount of stabilizing agent to be used in the final stage with hydrogen peroxide varies according to the type of wood used for the manufacture of the pulp as well as the operating conditions of the cooking which have prevailed during the pulping of the type of wood used and the effectiveness of the bleaching stages which have preceded the final stage with hydrogen peroxide. In certain cases, it is possible to use only a reduced amount of stabilising agent. Preferably, however, the amount of stabilising agent will be at least 0.1% by weight expressed with respect to the dry pulp. Most often, it will not exceed 5% and, preferably, not 4% of the dry pulp.

In accordance with the invention, the final stage with hydrogen peroxide is carried out at a consistency of at least 25% solids. Consistency is understood to denote the percentage by weight of the solids with respect to the total weight of the solids and of the aqueous solution of reactants. Preferably, the final stage with hydrogen peroxide will be carried out at a consistency of at least 30% solids.

Generally, the consistency of the final stage with hydrogen peroxide does not exceed 45%. A consistency of 30% has given very good results.

According to the invention, the pulp subjected to the final stage with hydrogen peroxide is selected from the pulps which have been delignified, in the stages which have preceded the final stage, to a high delignification level corresponding to a kappa number not exceeding 5. Preferably, the pulp subjected to the final stage will have a kappa number not exceeding 3. Generally, the pulp subjected to the final stage has a kappa number of at least 0.1. Any treatment sequence which makes it possible to delignify the pulp to such a value of the kappa number is in accordance with the invention. Examples of such sequences comprise sequences involving stages using at least one chlorinated reactant such as chlorine in acidic medium, chlorine dioxide, the combination of chlorine and of chlorine dioxide as a mixture or in sequence, the hypochlorite of an alkali metal or alkaline-earth metal or also, and preferably, sequences free of chlorinated reactants comprising at least one stage with oxygen, with ozone, or with an inorganic peroxoacid such as, for example, peroxomonosulphuric acid or Caro's acid, or also with an organic peroxyacid such as peioxyformic, peroxyacetic, peroxypropionic or peroxybutyric acid.

According to the invention, the pulp subjected to the final stage with hydrogen peroxide has been purified in the preceding stages such that its manganese content does not exceed 3 ppm by weight with respect to the solids. Any treatment sequence capable of purifying the pulp from manganese is in accordance-with the invention. Examples of such sequences comprise sequences involving stages using at least one acidic reactant such as sulphuric acid, sulphurous acid or chlorine, or a sequestering agent in acidic medium at a controlled pH. These various reactants can also be used in acidic medium at a controlled pH during washings of the pulp which are carried out between the delignification and/or bleaching stages.

Preferably, the manganese content of the pulp subjected to the final stage with hydrogen peroxide will not exceed 2 ppm by weight with respect to the solids.

In accordance with the invention, any treatment sequence of the pulp preceding the final stage with hydrogen peroxide, and capable of reducing the kappa number to 5 or less and the manganese content to 3 ppm or less, can be used to prepare the pulp to the bleaching operation by the final stage with hydrogen peroxide. In particular, it could be possible to use sequences involving chlorinated reactants such as chlorine in acidic medium, chlorine dioxide in acidic medium or the combination of chlorine and chlorine dioxide in acidic medium as a mixture or in sequence, or also the hypochlorites of alkali metals or alkaline-earth metals in alkaline medium. Preferably, sequences will, however, be aimed for which do not involve chlorinated reactants or, at the very least, limit the amount of chlorinated reactants, such as the sequences comprising at least one stage using gaseous oxygen, ozone, an acidic reactant, an alkaline reactant, or a peroxygenated compound in acidic or alkaline medium. Peroxygenated compound is understood to denote any inorganic or organic chemical compound comprising the group —O—O— in its molecule. Examples of such compounds are hydrogen peroxide, inorganic peroxoacids such as peroxomonosulphuric acid or Caro's acid and the inorganic persalts such as the perborates, percarbonates and perphosphates of alkali metals or alkaline-earth metals. Other examples of such peroxygenated compounds are organic carboxylic peroxyacids such as formic, acetic and propionic peracids and organic hydroperoxides such as tert-butyl hydroperoxide. Organic carboxylic peroxyacids are preferred. Among the latter, peracetic acid has given excellent results. It is also possible to conceive of treatment sequences which combine stages using chlorinated reactants with stages free of such reactants.

According to a first embodiment of the invention, the bleaching of the pulp is carried out using a treatment sequence of at least 4 stages comprising the sequence OC/DEpP, ODEpP, QPaaEpP and $QC_AEpP$. This notation is in accordance with that of the technical literature in the field of the bleaching of paper pulps. The symbols employed have the following meanings O: stage with gaseous oxygen under pressure, D: stage with chlorine dioxide, C/D: stage with chlorine and with chlorine dioxide applied as a mixture, Ep: stage of alkaline extraction in the presence of hydrogen peroxide, P: stage with hydrogen peroxide in alkaline medium, $C_A$: stage with peroxomonosulphuric acid (Caro's acid) or one of its salts, Paa: stage with peracetic acid, Q: stage of treatment with an acid or a sequestering acid.

Preferably, this first embodiment of the process according to the invention is carried out by performing Stage Ep of the bleaching sequence in the presence of a sequestering agent of metal ions. All sequestering agents of metal ions are well suited. Sequestering agents having a particular affinity for iron and manganese ions are particularly well suited. Examples of these agents are inorganic silicates, phosphates and polyphosphates such as silicates, pyrophosphates and metaphosphates of alkali metals, organic polycarboxylates and aminopolycarboxylates such as tartaric, citric, gluconic, ethylenediaminetetraacetic, diethylenetriaminepentaacetic or cyclohexanediaminetetraacetic acid and their salts, poly-α-hydroxyacrylic acids and their salts and phosphonic acids such as ethylenediaminetetra-(methylenephosphonic), diethylenetriaminepenta-(methylenephosphonic) or cyclohexanediamine-tetra(methylenephosphonic) acid and their salts.

Phosphonic acids and their salts have given the best results for sequestering metal ions in Stage Ep.

Stage Q of treatment with an acid or with a sequestering acid comprises the treatment with inorganic anhydrides or acids such as sulphur dioxide and sulphuric, sulphurous, hydrochloric and nitric acids or their acid salts, as well as organic acids such as carboxylic or phosphonic acids or their acid salts. Sulphur dioxide or alkali metal or alkaline-earth metal bisulphites are well suited. Bisulphite is understood to denote the acid salts of sulphurous acid corresponding to the formula $Me(HSO_3)_n$, in which Me symbolises a metal atom of valency n, n being an integer with a value 1 or 2. It also comprises the treatment with at least one sequestering agent in acidic medium, such as an inorganic phosphate or polyphosphate in acidic medium, such as, for example, a pyrophosphate or a metaphosphate of an alkali metal, an organic polycarboxylate or aminopolycarboxylate such as, for example, tartaric, citric, gluconic, ethylenediaminetetraacetic, diethylenetriaminepentaacetic or cyclohexanediaminetetraacetic acid and their salts, poly-α-hydroxyacrylic acid and its salts and a phosphonic acid such as ethylenediaminetetra(methylenephosphonic), diethylenetriaminepenta(methylenephosphonic) or cyclohexanediaminetetra(methylenephosphonic) acid and their salts.

Preferably, Stage Paa is carried out in the presence of a sequestering agent of metal ions. Known sequestering agents of metal ions such as iron and manganese are well suited. Examples of such sequestering agents are alkaline-earth metal salts, in particular soluble magnesium salts, inorganic silicates, phosphates and polyphosphates such as silicates, pyrophosphates and metaphosphates of alkali metals, organic polycarboxylates and aminopolycarboxylates such as tartaric, citric, gluconic, diethylenetriaminepentaacetic or cyclohexanediaminetetraacetic acid and their salts, poly-α-hydroxyacrylic acids and their salts and phosphonic acids such as ethylenediaminetetra (methylenephosphonic), diethylenetriaminepenta (methylenephosphonic) orcyclohexanediaminetetra (methylenephosphonic) acid and their salts. It is also possible to combine a number of these sequestering agents as a mixture. As a general rule, polycarboxylates or phosphonic acids give good results, in particular when they comprise at least one magnesium salt. Phosphonic acids and their salts have given the best results.

Stage $C_A$ of treatment with peroxomonosulphuric acid (Caro's acid) or one of its salts consists in treating the pulp with $H_2SO_5$ or one of its alkali metal, alkaline-earth metal or ammonium salts, or also with a mixture of a number of these salts or of $H_2SO_5$ with one or a number of these salts.

Peroxomonosulphuric acid or the salts used can, as a variant, have been prepared immediately before their use by reaction of a concentrated aqueous solution of sulphuric acid or of its salts with a concentrated aqueous solution of a peroxygenated compound, for example hydrogen peroxide. Concentrated solutions are understood to denote, respectively, $H_2SO_5$ solutions with a concentration of at least approximately 10 mol per liter and $H_2O_2$ solutions with a concentration of at least approximately 20% by weight.

Preferably, Stage $C_A$ is also carried out in the presence of a sequestering agent of metal ions. Advantageously, the same sequestering agents will be used as those which are suitable for Stage Paa and which have been described above. It is also possible to combine a number of these sequestering agents as a mixture.

The initial pH of Stage $C_A$ will be adjusted so that, at the end of the reaction, the pH remains greater than or equal to 2, and preferably 2.5. Likewise, it will be advisable that the pH at the end of the reaction does not exceed 7, and preferably not 6.

In the case of 4-stage sequences OC/DEpP or ODEpP, it is generally preferable to insert, between Stage Ep and Stage P, a washing of the pulp using an acidic aqueous solution. Acid is understood to denote inorganic anhydrides or acids such as sulphur dioxide and sulphuric, sulphurous, hydrochloric and nitric acids or their acid salts, as well as organic acids such as carboxylic or phosphonic acids or their acid salts. Sulphur dioxide or alkali metal or alkaline-earth metal bisulphites are well suited. Bisulphite is understood to denote acid salts of sulphurous acid corresponding to the formula $Me(HSO_3)_n$, in which Me symbolises a metal atom of valency n, n being an integer having the value 1 or 2.

The amount of acid to be used in the washing stage according to the invention depends on the type of wood and on the effectiveness of the preceding stages. Generally, the amount of acid will be that which is required for fixing the pH of the pulp at approximately at least 4, and preferably approximately at least 4.5. Likewise, the amount of acid will often be adjusted so that the pH does not exceed 7, and preferably not 6.5.

According to a second embodiment of the invention, the bleaching of the pulp is carried out by means of a treatment sequence, free of chlorinated reactant, of at least 5 stages comprising the sequence OQPDP, OQPPaaP, $OQPC_AP$ and OQPZP. In this sequence, the symbols used to denote the treatment stages have the same meaning as in the first embodiment of the invention as regards the symbols O, Q, Paa and P. The symbol Z is understood to be given the following meaning:

Z: treatment with ozone.

According to this second embodiment of the invention, Stages Q and Paa are carried out under conditions comparable to those described above for the first embodiment of the invention.

The stage of treatment with ozone consists in bringing the pulp into contact with a gaseous phase containing ozone.

Most often, the gaseous phase contains a mixture of ozone and of oxygen arising from an electric ozone generator which is supplied with dry gaseous oxygen.

The treatment of the pulp with ozone is carried out preferably in acidic medium. Values of pHs of at least 0.5 and preferably 1.5 and not exceeding 5, and preferably 4, are well suited.

The amount of hydrogen peroxide to be used in the final stage is generally at least 0.5% by weight with respect to the dry pulp, and preferably at least 0.8% of this weight. Likewise, it will be advisable for the amount of hydrogen peroxide in this treatment stage not to exceed 6% by weight with respect to the weight of dry pulp, and preferably not 5% of this weight.

The temperature of the final stage with hydrogen peroxide must be adjusted so as to remain at least equal to 50° C., and preferably to 70° C. It must also not exceed 140° C., and preferably not exceed 130° C.

The duration of the treatment with hydrogen peroxide in the final stage must be sufficient for the bleaching reaction to be complete. In practice, it will be set at a value of at least 15 minutes, and preferably 30 minutes. It should also most often not exceed 100 hours, and preferably 50 hours. A combination of temperature and duration conditions of approximately 80° C. and approximately 240 minutes has given good results.

The pH of the final stage with hydrogen peroxide is adjusted using the addition to the reaction mixture of an alkaline compound, for example sodium hydroxide, to an initial value of at least 10, and preferably of at least 11. Likewise, the initial pH of the final stage with hydrogen peroxide is generally adjusted to a value which does not exceed 13, and preferably not 12.

After the final stage with hydrogen peroxide, it is possible, and generally advantageous, to wash the bleached pulp with an acidic aqueous solution in order to bring its pH to a value not exceeding 6.5, and preferably not 6. Inorganic acids, such as sulphuric acid, sulphurous acid, hydrochloric acid or nitric acid, are well suited. Sulphurous acid obtained by the absorption of gaseous sulphur dioxide in water is particularly well suited.

The process according to the invention has the advantage of producing a significant gain in brightness. In particular, this gain can reach 20 to 25° ISO in the case of pulps whose brightness before the final stage with hydrogen peroxide is relatively low, for example softwood or hardwood kraft pulps with a brightness in the region of 65 to 70° ISO.

The process according to the invention finds an application in the delignification and the bleaching of chemical pulps of kraft or sulphite type, or of high-quality semi-chemical pulps, especially those which are intended for food packagings. It is suitable, without distinction, for pulps arising from softwoods or hardwoods.

The following examples are given to illustrate the invention, without limiting the scope thereof in any way. Examples 1R, 2R, 4R to 7R, 10R, 14R to 17R and 22R are not in accordance with the invention and have been given by way of reference. Examples 3, 8, 9, 11 to 13, 18 to 21 and 23 are in accordance with the invention.

In all the examples, the following standards have been used in the experimental determinations
brightness: ISO standard 2470,
kappa number: SCAN standard C1-59,
degree of polymerisation: SCAN standard C15-62,
tearing index: SCAN standard P11-64,
tensile strength index: SCAN standard P38-80,
degree of refining: SCAN standard C21-65.

EXAMPLES 1R AND 2R (Not in Accordance with the Invention).

A sample of softwood pulp which had been subjected to a kraft cooking (initial brightness 26.3° ISO, kappa number 31.2 and degree of polymerisation 1630) was bleached according to a 4-stage treatment sequence beginning with a stage with gaseous oxygen under pressure, followed by a stage comprising chlorine and chlorine dioxide in acidic medium and applied as a mixture, by a stage of alkaline extraction in the presence of hydrogen peroxide and by a final stage with hydrogen peroxide in alkaline medium (sequence symbolised by the initials OC/DEpP).

After bleaching, the brightness, kappa number and degree of polymerisation were determined on the treated pulp.

The operating conditions of the first three stages were the following:

| | | |
|---|---|---|
| 1st stage: stage with oxygen (Stage O): | | |
| pressure, bar: | 6 | |
| NaOH content, g/100 g of dry pulp: | 2.5 | |
| $MgSO_4 \cdot 7H_2O$ content, g/100 g of dry pulp: | 0.5 | |
| temperature, degrees C.: | 125 | |
| duration, min: | 40 | |
| consistency, % by weight of solids: | 10 | |
| 2nd stage: stage with chlorine/chlorine dioxide (Stage C/D): | | |
| active chlorine content, g/100 g of dry pulp: | 4.0 | |
| $Cl_2/ClO_2$ ratio (expressed as active Cl): | 60/40 | |
| temperature, degrees C.: | 50 | |
| duration, min: | 45 | |
| consistency, % by weight of solids: | 10 | |
| 3rd stage: stage of alkaline extraction (Stage Ep): | | |
| NaOH stage, g/100 g of dry pulp: | 3.2 | |
| $H_2O_2$ content, g/100 g of dry pulp: | 0.5 | |
| $DTMPNa_7$ content, g/100 g of dry pulp: | 0.0 | (Example 1R) |
| $DTMPNa_7$ content, g/100 g of dry pulp: | 0.1 | (Example 2R) |
| temperature, degrees C.: | 65 | |
| duration, min: | 60 | |
| consistency, % by weight of solids: | 10 | |

Before subjecting the pulp to the final stage with hydrogen peroxide, it was washed using an aqueous solution containing 1 g of $H_2SO_4$/100 g of dry pulp (which brought the pulp to a pH of 5) at 20° C. for 10 minutes and at a consistency of 2.5%.

The Mn content of the pulp after Stage Ep was 2.9 ppm by weight with respect to the solids in Example 1R and 1.1 ppm in Example 2R.

The final stage with hydrogen peroxide was then carried out in the absence of stabilising agents at 80° C., at a consistency of 30% and for 240 minutes by using 2.0 g of hydrogen peroxide and 2.0 g of NaOH per 100 g of dry pulp.

The results obtained are given in the following table:

| Example No. | Brightness °ISO | Kappa number before P | Degree of polymerisation after P |
|---|---|---|---|
| 1R | 85.2 | 1.5 | 850 |
| 2R | 86.4 | 1.6 | 880 |

The gain in brightness produced in the final stage with hydrogen peroxide was 15.4° ISO for Example 1R, and 16.4° ISO for Example 2R. At the conclusion of the final stage with hydrogen peroxide, all of the latter had been consumed in each of Examples 1R and 2R.

EXAMPLE 3

(In Accordance with the Invention)

Example 2R was reproduced, except that 2.0 g of Na silicate, at 38° Bé, and 0.6 g of $MgSO_4.7H_2O$ per 100 g of dry pulp were additionally introduced in Stage P.

After Stage Ep, the Mn content of the pulp was 1.1 ppm by weight with respect to the solids and its kappa number was 1.9.

The results obtained were:

| Example No. | Brightness °ISO | $H_2O_2$ consumed % weight | Degree of polymerisation |
|---|---|---|---|
| 3 | 89.5 | 61.9 | 1080 |

The gain in brightness achieved during the final Stage P was 23.5° ISO.

EXAMPLE 4R (Not in Accordance with the Invention)

Example 3 was reproduced, except that the final stage with hydrogen peroxide was carried out at moderate consistency (10% solids) and in the presence of 3 g of $H_2O_2$, 3.0 g of NaOH, 3.0 g of 38° Bé Na silicate and 1.0 g of $MgSO_4.7H_2O$ per 100 g of dry pulp.

After Stage Ep, the Mn content of the pulp was 1.1 ppm by weight with respect to the solids and its kappa number was 1.9.

The results were the following:

| Example No. | Brightness °ISO | Degree of polymerisation |
|---|---|---|
| 4R | 86.6 | 1200 |

EXAMPLES 5R TO 7R (Not in Accordance with the Invention)

Example 3 was reproduced, the chlorine in the second stage being replaced by an equivalent amount of chlorine dioxide (expressed as active chlorine) so as to produce a sequence ODEpP. Moreover, the temperature of Stage D was brought to 70° C. and the amount of NaOH in the final Stage P was varied between 1.5 and 2.3 g/100 g of dry pulp.

The Mn content determined before the final Stage P was 9 ppm by weight with respect to the solids and the kappa number was 3.0.

The results obtained were the following:

| Example No. | NaOH content in Stage P, % | Brightness °ISO | $H_2O_2$ consumed % |
|---|---|---|---|
| 5R | 1.5 | 81.8 | 100 |
| 6R | 1.9 | 81.3 | 100 |
| 7R | 2.3 | 81.6 | 100 |

EXAMPLE 8

(In Accordance with the Invention)

An attempt was made to lower the manganese content of the pulp obtained after Stage Ep of a bleaching sequence ODEpP carried out as in Examples 5R to 7R by inserting, between stages O and D, on the one hand, and between Stages D and Ep, on the other hand, a washing treatment of the pulp using a sequestering agent solution. The washing carried out between Stages O and D consisted of a washing in the presence of 0.12% of diethylenetriaminepentaacetic acid (DTPA) and 2.0% of sulphuric acid, and that carried out between Stage D and Stage Ep consisted of a washing in the presence of 0.2% of the heptasodium salt of diethylenetriaminepenta-(methylenephosphonic) acid ($DTMPNa_7$). The final Stage P was carried out with 2.0 g of $H_2O_2$/100 g of dry pulp as in Examples 7R to 9R, in the presence of 1.6 g of NaOH, of 3.0 g of 38° Bé Na silicate and of 1 g of $MgSO_4.7H_2O$/100 g of dry pulp.

The Mn content after Stage Ep was lowered to 2.7 ppm by weight with respect to the solids and the kappa number was 2.1.

The results obtained were the following:

| Example No. | NaOH content in Stage P, % | Brightness °ISO | $H_2O_2$ consumed % | Degree of polymer-isation |
|---|---|---|---|---|
| 8 | 1.6 | 89.2 | 54.4 | 1130 |

The gain in brightness produced during the final Stage P was 13.7° ISO.

EXAMPLE 9

(In Accordance with the Invention)

Another sample of softwood pulp, which had been subjected to a kraft cooking (initial brightness 29.4° ISO, kappa number 26.0 and degree of polymerisation 1500), was bleached using a 5-stage sequence OQPPaaP, entirely free of chlorinated reactants, under the following operating conditions:

| | |
|---|---|
| 1st stage: stage with oxygen (O): | |
| pressure, bar: | 5.5 |
| NaOH content, g/100 g of dry pulp: | 4.0 |
| $MgSO_4 \cdot 7H_2O$ content, g/100 g of dry pulp: | 0.5 |
| temperature, degrees C.: | 120 |
| duration, min: | 60 |
| consistency, % by weight of solids: | 12 |
| 2nd stage: stage with a sequestering acid (Q): | |
| DTPA content, g/100 g of dry pulp: | 0.12 |
| $SO_2$ content, g/100 g of dry pulp: | 0.42 |
| temperature, degrees C.: | 50 |
| duration, min: | 30 |
| consistency, % by weight of solids: | 10 |
| 3rd stage: stage with $H_2O_2$ (P): | |
| $H_2O_2$ content, g/100 g of dry pulp: | 1.0 |
| NaOH content, g/100 g of dry pulp: | 1.2 |
| 38 °Bé Na silicate content, g/100 g of dry pulp: | 3.0 |
| $MgSO_4 \cdot 7H_2O$ content, g/100 g of dry pulp: | 1.0 |
| $DTMPNa_7$ content, g/100 g of dry pulp: | 0.1 |
| temperature, degrees C.: | 90 |
| duration, min: | 120 |
| consistency, % by weight of solids: | 10 |
| 4th stage: stage with peracetic acid (Paa): | |
| Paa content, g/100 g of dry pulp: | 3.0 |
| $DTMPNa_7$ content, g/100 g of dry pulp: | 0.5 |
| temperature, degrees C.: | 90 |
| duration, min: | 240 |
| consistency, % by weight of solids: | 10 |
| 5th stage: final stage with hydrogen peroxide (P): | |
| $H_2O_2$ content, g/100 g of dry pulp: | 2.0 |
| NaOH content, g/100 g of dry pulp: | 1.6 |
| 38 °Bé Na silicate content, g/100 g of dry pulp: | 3.0 |
| $MgSO_4 \cdot 7H_2O$ content, g/100 g of dry pulp: | 1.0 |
| temperature, degrees C.: | 90 |
| duration, min: | 240 |
| consistency, % by weight of solids: | 30 |

The kappa number of the pulp after Stage Paa was 4.3 and its Mn content was 0.2 ppm by weight with respect to the solids.

The results obtained were the following:

| Example No. | Brightness °ISO | Kappa number | Degree of polymerisation |
|---|---|---|---|
| 9 | 90.6 | 1.6 | 970 |

The gain in brightness produced during the final Stage P was 22.4° ISO.

EXAMPLE 10R (Not in Accordance with the Invention)

A sample of a pulp of a mixture of softwoods from Finland, which had been subjected to a kraft cooking (initial brightness 27.9° ISO, kappa number 26.7 and degree of polymerisation 1680), was bleached using a conventional 6-stage sequence OC/DEDED under the following operating conditions:

| | |
|---|---|
| 1st stage: stage with oxygen (O): | |
| pressure, bar: | 6.0 |
| NaOH content, g/100 g of dry pulp: | 4.0 |
| $MgSO_4 \cdot 7H_2O$ content, g/100 g of dry pulp: | 0.5 |
| temperature, degrees C.: | 120 |
| duration, min: | 60 |
| consistency, % by weight of solids: | 12 |
| 2nd stage: stage with chlorine/chlorine dioxide (Stage C/D): | |
| active chlorine content, g/100 g of dry pulp: | 2.0 |
| $Cl_2/ClO_2$ ratio (expressed as active Cl): | 50/50 |
| temperature, degrees C.: | 50 |
| duration, min: | 30 |
| consistency, % by weight of solids: | 4 |

-continued

| | |
|---|---|
| 3rd stage: stage of alkaline extraction (Stage E): | |
| NaOH content, g/100 g of dry pulp: | 2.0 |
| temperature, degrees C.: | 90 |
| duration, min: | 120 |
| consistency, % by weight of solids: | 10 |
| 4th stage: stage with chlorine dioxide (Stage D): | |
| active chlorine content, g/100 g of dry pulp: | 2.0 |
| temperature, degrees C.: | 70 |
| duration, min: | 120 |
| consistency, % by weight of solids: | 10 |
| 5th stage: stage of alkaline extraction (Stage E): | |
| NaOH content, g/100 g of dry pulp: | 1.0 |
| temperature, degrees C.: | 70 |
| duration, min: | 90 |
| consistency, % by weight of solids: | 10 |
| 6th stage: stage with chlorine dioxide (Stage D): | |
| active chlorine content, g/100 g of dry pulp: | 1.0 |
| temperature, degrees C.: | 70 |
| duration, min: | 120 |
| consistency, % by weight of solids: | 10 |

The results obtained were the following:

| Example No. | Final brightness °ISO | Degree of polymerisation |
|---|---|---|
| 10R | 91.5 | 1100 |

The mechanical properties of the bleached pulp (tearing index and tensile strength index) after refining in a laboratory refiner were also determined.

The results were the following:

| Degree of refining °SR | Tearing index $mN \cdot m^2/g$ | Tensile strength index $N \cdot m/g$ |
|---|---|---|
| 15 | 17.7 | 25.5 |
| 19 | 15.4 | 71.0 |
| 24 | 12.7 | 80.4 |
| 28 | 12.1 | 74.7 |
| 30 | 12.8 | 77.5 |

EXAMPLE 11

(In Accordance with the Invention)

The same sample of softwood pulp as in Example 10R was bleached using a 5-stage sequence OQPDP, free of elemental chlorine, under the following operating conditions:

| | |
|---|---|
| 1st stage: stage with oxygen (O): | |
| pressure, bar: | 6.0 |
| NaOH content, g/100 g of dry pulp: | 4.0 |
| $MgSO_4 \cdot 7H_2O$ content, g/100 g of dry pulp: | 0.5 |
| temperature, degrees C.: | 120 |
| duration, min: | 60 |
| consistency, % by weight of solids: | 12 |
| 2nd stage: stage with a sequestering acid (Q): | |
| DTPA content, g/100 g of dry pulp: | 0.5 |
| $H_2SO_4$ for a pH of: | 6 |

-continued

| | |
|---|---|
| temperature, degrees C.: | 50 |
| duration, min: | 30 |
| consistency, % by weight of solids: | 4 |
| 3rd stage: stage with $H_2O_2$ (P): | |
| $H_2O_2$ content, g/100 g of dry pulp: | 2.0 |
| NaOH content, g/100 g of dry pulp: | 2.0 |
| $MgSO_4 \cdot 7H_2O$ content, g/100 g of dry pulp: | 0.2 |
| $DTMPNa_7$ content, g/100 g of dry pulp: | 0.1 |
| temperature, degrees C.: | 90 |
| duration, min: | 120 |
| consistency, % by weight of solids: | 10 |
| 4th stage: stage with chlorine dioxide (Stage D): | |
| active chlorine content, g/100 g of dry pulp: | 1.5 |
| temperature, degrees C.: | 70 |
| duration, min: | 120 |
| consistency, % by weight of solids: | 10 |
| 5th stage: final stage with hydrogen peroxide (P): | |
| $H_2O_2$ content, g/100 g of dry pulp: | 2.0 |
| NaOH content, g/100 g of dry pulp: | 1.6 |
| 38 °Bé Na silicate content, g/100 g of dry pulp: | 3.0 |
| $MgSO_4 \cdot 7H_2O$ content, g/100 g of dry pulp: | 1.0 |
| temperature, degrees C.: | 90 |
| duration, min: | 240 |
| consistency, % by weight of solids: | 30 |

The results obtained were the following:

| Example No. | Final brightness °ISO | Kappa number after D | Degree of polymerisation |
|---|---|---|---|
| 11 | 92.7 | 3.6 | 1040 |

The Mn content of the pulp after Stage D was 0.7 ppm by weight with respect to the solids.

| Degree of refining °SR | Tearing index $mN \cdot m^2/g$ | Tensile strength index $N \cdot m/g$ |
|---|---|---|
| 16 | 20.0 | 43.7 |
| 26 | 11.3 | 87.9 |
| 31 | 9.6 | 91.1 |
| 34 | 11.1 | 94.8 |
| 38 | 9.8 | 96.8 |

EXAMPLE 12

(In Accordance with the Invention)

The same sample of softwood pulp as in Examples 10R and 11 was bleached using a 5-stage sequence OQPPaaP, entirely free of chlorine, under the following operating conditions:

| | |
|---|---|
| 1st stage: stage with oxygen (O): | |
| pressure, bar: | 6.0 |
| NaOH content, g/100 g of dry pulp: | 4.0 |
| $MgSO_4 \cdot 7H_2O$ content, g/100 g of dry pulp: | 0.5 |
| temperature, degrees C.: | 120 |
| duration, min: | 60 |
| consistency, % by weight of solids: | 12 |

-continued

| | |
|---|---|
| 2nd stage: stage with a sequestering acid (Q): | |
| DTPA content, g/100 g of dry pulp: | 0.2 |
| $SO_2$ for a pH of: | 6 |
| temperature, degrees C.: | 90 |
| duration, min: | 60 |
| consistency, % by weight of solids: | 4 |
| 3rd stage: stage with $H_2O_2$ (P): | |
| $H_2O_2$ content, g/100 g of dry pulp: | 2.0 |
| NaOH content, g/100 g of dry pulp: | 2.0 |
| $MgSO_4 \cdot 7H_2O$ content, g/100 g of dry pulp: | 0.2 |
| $DTMPNa_7$ content, g/100 g of dry pulp: | 0.1 |
| temperature, degrees C.: | 90 |
| duration, min: | 120 |
| consistency, % by weight of solids: | 10 |
| 4th stage: stage with peracetic acid (Paa): | |
| Paa content, g/100 g of dry pulp: | 3.0 |
| $DTMPNa_7$ content, g/100 g of dry pulp: | 0.1 |
| $MgSO_4 \cdot 7H_2O$ content, g/100 g of dry pulp: | 0.2 |
| temperature, degrees C.: | 90 |
| duration, min: | 120 |
| consistency, % by weight of solids: | 10 |
| 5th stage: final stage with hydrogen peroxide (P): | |
| $H_2O_2$ content, g/100 g of dry pulp: | 2.0 |
| NaOH content, g/100 g of dry pulp: | 1.6 |
| 38 °Bé Na silicate content, g/100 g of dry pulp: | 3.0 |
| $MgSO_4 \cdot 7H_2O$ content, g/100 g of dry pulp: | 1.0 |
| temperature, degrees C.: | 90 |
| duration, min: | 240 |
| consistency, % by weight of solids: | 30 |

The results obtained were the following:

| Example No. | Final brightness °ISO | Kappa number after Paa | Degree of polymerisation |
|---|---|---|---|
| 12 | 91.4 | 3.3 | 1060 |

The Mn content of the pulp after Stage Paa was 0.4 ppm by weight with respect to the solids.

| Degree of refining °SR | Tearing index $mN \cdot m^2/g$ | Tensile strength index $N \cdot m/g$ |
|---|---|---|
| 16 | 20.7 | 38.2 |
| 24 | 11.4 | 80.9 |
| 33 | 10.4 | 92.3 |
| 38 | 10.1 | 100.4 |

EXAMPLE 13

(In Accordance with the Invention)

The same sample of softwood pulp as in Examples 10R, 11 and 12 was bleached using a 5-stage sequence $OQPC_AP$, entirely free of chlorine, under the following operating conditions:

| | |
|---|---|
| 1st stage: stage with oxygen (O): | |
| pressure, bar: | 6.0 |
| NaOH content, g/100 g of dry pulp: | 4.0 |
| $MgSO_4.7H_2O$ content, g/100 g of dry pulp: | 0.5 |

-continued

| | |
|---|---|
| temperature, degrees C.: | 120 |
| duration, min: | 60 |
| consistency, % by weight of solids: | 12 |
| 2nd stage: stage with a sequestering acid (Q): | |
| DTPA content, g/100 g of dry pulp: | 0.2 |
| $SO_2$ for a pH of: | 6 |
| temperature, degrees C.: | 90 |
| duration, min: | 60 |
| consistency, % by weight of solids: | 4 |
| 3rd stage: stage with $H_2O_2$ (P): | |
| $H_2O_2$ content, g/100 g of dry pulp: | 2.0 |
| NaOH content, g/100 g of dry pulp: | 2.0 |
| $MgSO_4.7H_2O$ content, g/100 g of dry pulp: | 0.2 |
| $DTMPNa_7$ content, g/100 g of dry pulp: | 0.1 |
| temperature, degrees C.: | 90 |
| duration, min: | 120 |
| consistency, % by weight of solids: | 10 |
| 4th stage: stage with Caro's acid ($C_A$): | |
| $H_2SO_5$ content, g/100 g of dry pulp: | 4.5 |
| $DTMPNa_7$ content, g/100 g of dry pulp: | 0.1 |
| $MgSO_4.7H_2O$ content, g/100 g of dry pulp: | 0.2 |
| temperature, degrees C.: | 90 |
| duration, min: | 120 |
| consistency, % by weight of solids: | 10 |
| 5th stage: final stage with hydrogen peroxide (P): | |
| $H_2O_2$ content, g/100 g of dry pulp: | 2.0 |
| NaOH content, g/100 g of dry pulp: | 1.6 |
| 38° Bé Na silicate content, g/100 g of dry pulp: | 3.0 |
| $MgSO_4.7H_2O$ content, g/100 g of dry pulp: | 1.0 |
| temperature, degrees C.: | 90 |
| duration, min: | 240 |
| consistency, % by weight of solids: | 30 |

The results obtained were the following:

| Example No. | Final brightness °ISO | Kappa number after $C_A$ | Degree of polymerisation |
|---|---|---|---|
| 13 | 90.2 | 4 | 1020 |

The Mn content of the pulp after Stage $C_A$ was 0.2 ppm by weight with respect to the solids.

| Degree of refining °SR | Tearing index $mN \cdot m^2/g$ | Tensile strength index $N \cdot m/g$ |
|---|---|---|
| 16 | 20.4 | 40.8 |
| 24 | 11.5 | 81.6 |
| 33 | 11.2 | 90.0 |
| 39 | 10.5 | 98.6 |
| 47 | 9.9 | 101.2 |

EXAMPLES 14R TO 17R (Not in Accordance with the Invention)

Another sample of a pulp of a mixture of softwoods from Finland, which had been subjected to a kraft cooking (initial brightness 30.5° ISO, kappa number 26.7 and degree of polymerisation 1510), was bleached using a 4-stage sequence QPaaEpP, entirely free of chlorinated reactants, under the following operating conditions:

| 1st stage: stage with a sequestering acid (Q): | |
|---|---|
| DTPA content, g/100 g of dry pulp: | 0.16 |
| $H_2SO_4$ content, g/100 g of dry pulp: | 0.5 |
| temperature, degrees C.: | 55 |
| duration, min: | 30 |
| consistency, % by weight of solids: | 3 |
| 2nd stage: stage with peracetic acid (Paa): | |
| Paa content, g/100 g of dry pulp: | 9.0 |
| $DTMPNa_7$ content, g/100 g of dry pulp: | 0.25 |
| temperature, degrees C.: | 90 |
| duration, min: | 240 |
| consistency, % by weight of solids: | 10 |
| 3rd stage: stage of alkaline extraction (Stage Ep): | |
| NaOH content, g/100 g of dry pulp: | 3.0 |
| $H_2O_2$ content, g/100 g of dry pulp: | 0.5 |
| $DTMPNa_7$ content, g/100 g of dry pulp: | 0.1 |
| temperature, degrees C.: | 70 |
| duration, min: | 60 |
| consistency, % by weight of solids: | 10 |

| 4th stage: stage with $H_2O_2$ (P) | Example Nos. | | | |
|---|---|---|---|---|
| | 14R | 15R | 16R | 17R |
| $H_2O_2$ content, g/100 g of dry pulp: | 2.0 | 2.0 | 1.5 | 1.0 |
| NaOH content, g/100 g of dry pulp: | 1.6 | 1.6 | 1.3 | 1.0 |
| 38° Bé Na silicate content, g/100 g of dry pulp: | 3.0 | 3.0 | 3.0 | 3.0 |
| $MgSO_4.7H_2O$ content, g/100 g of dry pulp: | 1.0 | 1.0 | 1.0 | 1.0 |
| temperature, degrees C.: | 90 | 120 | 120 | 120 |
| duration, min: | 240 | 240 | 240 | 240 |
| consistency, % by weight of solids: | 10 | 10 | 10 | 10 |

The results obtained are given in the following table:

| Example No. | Final brightness °ISO | Kappa number before P | Degree of polymerisation after P |
|---|---|---|---|
| 14R | 84.0 | 4.2 | 1270 |
| 15R | 88.5 | 4.2 | 1190 |
| 16R | 87.2 | 4.2 | 1230 |
| 17R | 84.4 | 4.2 | 1250 |

EXAMPLES 18 TO 21

(In Accordance with the Invention)

The same sample of softwood pulp as in Examples 14R to 17R was bleached using the same 4-stage bleaching sequence QPaaEpP under the following conditions:

| 1st stage: stage with a sequestering acid (Q): | |
|---|---|
| DTPA content, g/100 g of dry pulp: | 0.16 |
| $H_2SO_4$ content, g/100 g of dry pulp: | 0.5 |
| temperature, degrees C.: | 55 |
| duration, min: | 30 |
| consistency, % by weight of solids: | 3 |
| 2nd stage: stage with peracetic acid (Paa): | |
| Paa content, g/100 g of dry pulp: | 9.0 |
| $DTMPNa_7$ content, g/100 g of dry pulp: | 0.25 |
| temperature, degrees C.: | 90 |
| duration, min: | 240 |
| consistency, % by weight of solids: | 10 |

-continued

| 3rd stage: stage of alkaline extraction (Stage Ep): | |
|---|---|
| NaOH content, g/100 g of dry pulp: | 3.0 |
| $H_2O_2$ content, g/100 g of dry pulp: | 0.5 |
| $DTMPNa_7$ content, g/100 g of dry pulp: | 0.1 |
| temperature, degrees C.: | 70 |
| duration, min: | 60 |
| consistency, % by weight of solids: | 10 |

| 4th stage: stage with $H_2O_2$ (P) | Example Nos. | | | |
|---|---|---|---|---|
| | 18 | 19 | 20 | 21 |
| $H_2O_2$ content, g/100 g of dry pulp: | 2.0 | 2.0 | 1.5 | 1.0 |
| NaOH content, g/100 g of dry pulp: | 1.6 | 1.6 | 1.3 | 1.0 |
| 38° Bé Na silicate content, g/100 g of dry pulp: | 3.0 | 3.0 | 3.0 | 3.0 |
| $MgSO_4.7H_2O$ content, g/100 g of dry pulp: | 1.0 | 1.0 | 1.0 | 1.0 |
| temperature, degrees C.: | 90 | 120 | 120 | 120 |
| duration, min: | 240 | 240 | 240 | 240 |
| consistency, % by weight of solids: | 30 | 30 | 30 | 30 |

These operating conditions are identical to those of Examples 14R to 17R, except the consistency of the final Stage P which was brought to 30% solids.

The results obtained are given in the following table:

| Example No. | Final brightness °ISO | Kappa number before P | Degree of polymerisation after P |
|---|---|---|---|
| 18 | 89.9 | 4.2 | 1210 |
| 19 | 92.6 | 4.2 | 1030 |
| 20 | 91.8 | 4.2 | 1110 |
| 21 | 89.8 | 4.2 | 1180 |

EXAMPLES 22R (NOT IN ACCORDANCE WITH THE INVENTION) AND 23

(In Accordance with the Invention)

The same sample of softwood kraft pulp (initial brightness 30.5° ISO, kappa number 26.7 and degree of polymerisation 1510) as that used in Examples 14R to 17R and 18 to 21 was bleached using a 5-stage sequence OQPZP, entirely free of chlorinated reactants, under the following operating conditions:

| 1st stage: stage with oxygen (O): | |
|---|---|
| pressure, bar: | 5.5 |
| NaOH content, g/100 g of dry pulp: | 4.0 |
| $MgSO_4.7H_2O$ content, g/100 g of dry pulp: | 0.5 |
| temperature, degrees C.: | 120 |
| duration, min: | 60 |
| consistency, % by weight of solids: | 14 |
| 2nd stage: stage with a sequestering acid (Q): | |
| DTPA content, g/100 g of dry pulp: | 0.2 |
| $SO_2$ content, g/100 g of dry pulp: | 0.5 |
| temperature, degrees C.: | 25 |
| duration, min: | 30 |
| consistency, % by weight of solids: | 4 |
| 3rd stage: stage with $H_2O_2$ (P): | |
| $H_2O_2$ content, g/100 g of dry pulp: | 2.0 |
| NaOH content, g/100 g of dry pulp: | 1.5 |
| temperature, degrees C.: | 90 |
| duration, min: | 120 |
| consistency, % by weight of solids: | 10 |

-continued

| | |
|---|---|
| 4th stage: stage with ozone (Z): | |
| $O_3$ content, g/100 g of dry pulp: | 1.25 |
| temperature, degrees C.: | 25 |
| duration, min: | 14 |
| consistency, % by weight of solids: | 40 |
| 5th stage: final stage with hydrogen peroxide (P): | |
| $H_2O_2$ content, g/100 g of dry pulp: | 2.0 |
| NaOH content, g/100 g of dry pulp: | 1.6 |
| 38° Bé Na silicate content, g/100 g of dry pulp: | 3.0 |
| $MgSO_4.7H_2O$ content, g/100 g of dry pulp: | 1.0 |
| temperature, degrees C.: | 90 |
| duration, min: | 240 |
| consistency, % by weight of solids: | 10 (Example 22R)<br>30 (Example 23) |

The results obtained were the following:

| Example No. | Final brightness °ISO | Kappa number after Z |
|---|---|---|
| 22R | 86.2 | 3.4 |
| 23 | 89.0 | 3.4 |

What is claimed is:

1. A process for bleaching a chemical paper pulp to obtain levels of brightness of at least 89° ISO, comprising:

subjecting a chemical paper pulp to a sequence of treatment stages including purification prior to a final stage so that its manganese content does not exceed 3 ppm by weight with respect to the solids, and delignification prior to a final stage to a kappa number (measured according to the SCAN standard C1-59) not exceeding 5, said sequence of treatment stages thereafter including a final stage with hydrogen peroxide in an alkaline medium, said final stage with hydrogen peroxide carried out in the presence of at least one stabilising agent, at a consistency of at least 25% by weight of solids.

2. The process according to claim 1, wherein the kappa number of the pulp subjected to the final stage with hydrogen peroxide is between 0.1 and 3.

3. The process according to claim 1, wherein the consistency of the final stage with hydrogen peroxide is at least 30% by weight of solids.

4. The process according to claim 1, wherein the manganese content of the pulp is reduced during one or a number of operations for the removal of metals using sequestering acids or agents in aqueous solution at a controlled acidic pH.

5. The process according to claim 1, wherein the stabilising agent of the final stage with hydrogen peroxide comprises sodium silicate.

6. The process according to claim 1, wherein the bleaching is carried out in a treatment sequence consisting of, other than intermediate stages with a wash composed of water, a four-stage treatment sequence selected from the group consisting of O C/D Ep P, O D Ep P, Q Paa Ep P, and Q $C_A$ Ep P, wherein:

O stands for a stage with gaseous oxygen under pressure,

D stands for a stare with chlorine dioxide,

C/D stands for a stage with chlorine and with chlorine dioxide applied as a mixture, $E_p$ stands for a stare of alkaline extraction in the presence of hydrogen peroxide, P stands for a stage with hydrogen peroxide in an alkaline medium, $C_A$ stands for a stage with peroxomonosulfuric acid or one of its salts, Paa stands for a stare with peracetic acid, and Q stands for a stare with an acid or a sequestering acid.

7. The process according to claim 6, wherein Stage Ep is carried out in the presence of at least one sequestering agent of metal ions.

8. The process according to claim 7, wherein the sequestering agent is selected from the group consisting of phosphonic acids and their salts.

9. The process according to claim 6, wherein a washing of the pulp using an acidic aqueous solution is inserted between Stage Ep and Stage P.

10. The process according to claim 1, wherein the bleaching is carried out in a treatment sequence consisting of, other than intermediate stages with a wash composed of water, a five-stage treatment sequence selected from the group consisting of O Q P D P, O Q P Paa P, O Q P $C_A$ P, and O Q P Z P, wherein:

O stands for a stage with gaseous oxygen under pressure,

D stands for a stage with chlorine dioxide,

Z stands for a stage with ozone,

P stands for a stage with hydrogen peroxide in an alkaline medium, $C_A$ stands for a stage with peroxomonosulfuric acid or one of its salts, Paa stands for a stare with peracetic acid, and O stands for a stare with an acid or a sequestering acid.

11. The process according to claim 10, wherein stages Paa and $C_A$ are carried out in the presence of at least one sequestering agent of metal ions.

12. The process according to claim 1, wherein the temperature of the final stage with hydrogen peroxide is between about 50 and 140° C.

13. A process for bleaching a kraft paper pulp to obtain levels of brightness of at least 89° ISO, comprising:

subjecting a kraft paper pulp to a sequence of treatment stages including purification prior to a final stage so that its manganese content does not exceed 3 ppm by weight with respect to the solids, and delignification prior to a final stage to a kappa number (measured according to the SCAN standard C1-59) not exceeding 5, said sequence of treatment stages thereafter including a final stage with hydrogen peroxide in alkaline medium, said final stage with hydrogen peroxide carried out in the presence of at least one stabilising agent, at a consistency of at least 25% by weight of solids.

* * * * *